United States Patent [19]

Hiraishi et al.

[11] Patent Number: 4,561,890

[45] Date of Patent: Dec. 31, 1985

[54] TWO-PHASE STAINLESS CAST STEEL HAVING HIGH CORROSION FATIGUE STRENGTH

[75] Inventors: Hisashi Hiraishi, Kyoto; Hisakatsu Nishihara, Hirakata; Hiroyuki Shiokawa, Osaka, all of Japan

[73] Assignee: Kubota Ltd., Osaka, Japan

[21] Appl. No.: 641,408

[22] Filed: Aug. 16, 1984

Related U.S. Application Data

[63] Continuation of Ser. No. 465,520, Feb. 10, 1983, abandoned.

[30] Foreign Application Priority Data

Feb. 23, 1982 [JP] Japan ..... 57-27665

[51] Int. Cl.[4] ..... C22C 38/52

[52] U.S. Cl. ..... 75/125; 75/128 B; 75/128 V; 75/128 W; 75/128 G; 75/128 T; 148/37; 148/38

[58] Field of Search ..... 75/125, 128 B, 128 G, 75/128 T, 128 W, 128 V; 148/37, 38

[56] References Cited

U.S. PATENT DOCUMENTS

Re. 28,523 8/1975 Hill et al. ..... 75/128 B

FOREIGN PATENT DOCUMENTS 5091516 12/1973 Japan ..... 75/125
55-44528 3/1980 Japan ..... 148/37
0158256 12/1980 Japan ..... 148/37

OTHER PUBLICATIONS

Reed-Hill, Robert, Physical Metallurgy Principles, 2nd Ed., 1973, p. 813.

Brick et al., Structure and Properties of Engineering Materials, 4th Ed., 1977, pp. 458–459.

*Primary Examiner*—L. Dewayne Rutledge
*Assistant Examiner*—Deborah Yee
*Attorney, Agent, or Firm*—Oblon, Fisher, Spivak, McClelland & Maier

[57] ABSTRACT

A stainless cast steel of ferrite-austenite two-phase structure having high corrosion fatigue strength and high pitting corrosion resistance containing in terms of % by weight, up to 0.1% C, up to 2.0% Si, up to 2.0% Mn, 22.0–27.0% Cr, 5.0–9.0% Ni, 1.1–2.5% Mo, 0.5–2.5% Cu, 0.5–2.0% Co and 0.5–2.0% V, the steel further containing, if desired, one or more kinds of 0.5–2.0% Nb and/or Ta and 0.01–0.5% Ti, the balance being substantially Fe and inevitable impurities.

3 Claims, No Drawings

TWO-PHASE STAINLESS CAST STEEL HAVING HIGH CORROSION FATIGUE STRENGTH

This application is a continuation of application Ser. No. 465,520, filed Feb. 10, 1983, now abandoned.

The present invention relates to an improved stainless cast steel of ferrite-austenite two-phase structure, and more particularly to a ferrite-austenite stainless cast steel having high corrosion fatigue strength and high resistance to pitting corrosion.

Stainless cast steels of ferrite-austenite two-phase structure are known as materials excelling in proof stress and corrosion resistance owing to their structural characteristics, and are widely used as the members of machines where proof stress and corrosion resistance are required. However, the conventional materials such as Japanese Industrial Standard (hereinafter referred to as JIS) SCS 11 (25Cr-5Ni-2Mo) or JIS SCS 14 (18Cr-12Ni-2.5Mo) are not sufficient in the corrosion fatigue strength under corrosive atmosphere containing chlorine ions, and the material deterioration is accelerated at the early stage of use when the material is used under conditions of repeated stresses and thus the material is not sufficiently stable to be used for construction members.

Thus, the conventional materials have problems in durability and stability when they are used in applications where high corrosion fatigue strength together with high proof stress and high corrosion resistance are required, such as a suction roll for use in paper manufacturing , a sea water pump or other chemical apparatus.

SUMMARY OF THE INVENTION

The present invention solves these problems.

It is an object of this invention to provide a ferrite-austenite stainless cast steel having improved corrosion fatigue strength and excellent corrosion resistance along with increased proof stress.

Specifically, the present invention presents a two-phase stainless cast steel containing up to 0.1% C. (by weight, the same as hereinafter), up to 2.0% Si, up to 2.0% Mn, 22.0 to 27.0% Cr, 5.0 to 9.0% Ni, 1.1 to 2.5% Mo, 0.5 to 2.5% Cu, 0.5 to 2.0% Co, 0.5 to 2.0% V, the balance being substantially Fe and unavoidable impurities.

The present invention contains one or more of 0.05 to 2.0% Nb and/or Ta and 0.01 to 0.5% Ti in addition to the above-mentioned elements, if necessary, in order to further enhance the material properties.

The stainless steel according to the present invention has high corrosion fatigue strength and excellent corrosion resistance.

The stainless steel according to the present invention is well suited as materials for use in a paper manufacturing suction roll, chemical apparatus, pump parts and sea water handling equipment which are applied under a corrosive environment containing chlorine ions.

DETAILED DESCRIPTION OF THE INVENTION

The reasons for specifying the chemical composition of the present stainless cast steel are described below in detail. (The percentages are all by weight.)

C: up to 0.1%

C is a strong austenitizing element and serves to reinforce the matrix by being incorporated in the austenitic phase in the form of solid solution. However, as the C content increases, carbides in the form of $Cr_{23}C_6$ are formed to consume Cr which is useful for improving corrosion resistance, entailing reduced resistance to corrosion. Besides, an abundant precipitation of the carbides reduces toughness. Hence, the content of C should be up to 0.1%. Meanwhile, in casting of large-sized, thick-walled steel products, since a long time is required to complete the solidification of molten steel, an increase of carbide precipitation and segregation may be easily encouraged in the solidification process. The C content is therefore preferably up to 0.05% for casting the above cast steel products. The lower limit of the content should be a trace amount so that a slight austenitizing effect can be allowed.

Si: up to 2.0%

Si is a strong deoxidizer and also contributes to improvement of castability. However, a large amount of Si leads to deterioration in material properties such as brittleness. The upper limit of Si is therefore 2.0%. The lower limit of the content should be only a trace amount to allow an enhanced effect of deoxidizing or casting.

Mn: up to 2.0%

Mn has a strong deoxidizing and desulfurizing effect and also improves the castability. However, a large amount of Mn lowers the corrosion resistance. The upper limit of Mn is therefore 2.0%. The lower limit of the content should be only a trace amount to allow an improved effect of deoxidizing, desulfurizing or casting.

Cr: 22.0 to 27.0%

Cr is a ferrite forming element, and is a basic element indispensable for increasing the strength by forming ferrite phase and for obtaining corrosion resistance as stainless steel. At least 22.0% is required as its content to ensure high strength and high corrosion resistance. Although the effects are heightened as the content is increased, toughness is sacrificed at higher contents. Therefore, the upper limit is set at 27.0%.

Ni: 5.0 to 9.0%

Ni is an austenite forming element, and notably improves the toughness and corrosion resistance. Its content should be balanced with Cr to determine the ratio of ferrite quantity and austenite quantity of the two-phase structure. In the present invention, in order to maintain excellent characteristics, such as high corrosion resistance, high toughness and high strength, under proper quantitative balance of the two phases, the content of Ni is controlled within 5.0 to 9.0% in relation with the content of Cr.

Mo: 1.1 to 2.5%

Mo greatly improves the resistance to corrosion, in particular, to crevice corrosion and pitting corrosion. When the content is less than 1.1%, its effect is insufficient, or when higher than 2.5%, the material may be deteriorated due to reduction of toughness and promotion of $\sigma$-phase precipitation. Hence the Mo content should be limited to the range of 1.1 to 2.5%.

Cu: 0.5 to 2.5%

Cu serves to reinforce the matrix by being incorporated in the austenitic phase in the form of solid solution, and thus enhances the strength of the steel and also improves the corrosion resistance against non-oxidized acid. At least 0.5% is required for obtaining these offects, but higher contents may cause material deterioration such as brittleness due to precipitation of intermetallic compounds. Hence, the upper limit is set at 2.5%.

Co: 0.5 to 2.0%

Co contributes to reinforce the matrix by being incorporated in the austenitic phase in the form of solid solution and thus enhances the strength of the steel, and also improves the corrosion fatigue strength. With less than 0.5% of Co present, the effect will not be sufficient, whereas amounts above 2.0% will not achieve a correspondingly enhanced effect. The Co content is therefore 0.5 to 2.0%.

V: 0.5 to 2.0%

V is effective for making the grain structure finer and also for giving improvement in strength and corrosion fatigue strength. The effects are not sufficient when the content is less than 0.5%, and the effects are increased as the content becomes higher until they nearly level off at 2.0%. The V content is therefore within a range of 0.5 to 2.0%.

The stainless cast steel according to the present invention may contain, besides the above elements, one or more kinds of Nb and/or Ta and Ti.

Nb and/or Ta: 0.05 to 2.0%

Nb fixes carbon in the steel owing to a strong affinity for carbon, and enhances the corrosion resistance, in particular, the corrosion resistance at grain boundaries by inhibiting the precipitation of the carbide like $Cr_{23}C_6$. Nb also contributes to grain-refining in the steel, The effects are not sufficient when the Nb content is less than 0.05%. On the other hand, amounts above 2.0% will not obtain a correspondingly improved effect. Usually Nb inevitably contains Ta which has the same effect as Nb. Therefore, Nb may be replaced with Ta. When Nb contains Ta, accordingly, the combined amount of Nb and Ta may be 0.05 to 2.0%.

Ti: 0.01 to 0.5%

Ti combines with carbon to inhibit precipitation of $Cr_{23}C_6$, thereby improving the grain boundary corrosion resistance, and also has a grain-refining effect. Then the Ti content is less than 0.01%, sufficient effect is not obtained. Exceeding 0.5%, to the contrary, the effects level off and toughness may be lowered. The Ti content is therefore within a range of 0.01 to 0.5%.

Besides, P, S and other impurity elements unavoidably mixed in the industrial melting process should be as low as possible, but may be allowed in a customary technical range. For example, when the content of S is up to 0.04% and that of P is up to 0.04%, the objectives of the present invention are not impaired.

In the following the characteristics of the steel material of the present invention is described referring to the example.

EXAMPLE

The alloys having the composition as shown in Table 1 were melted, cast, heated at 1100° C. for 2 hours as solid solution treatment, and quenched to obtain specimens. Each specimen was measured with respect to 0.2% proof stress, tensile strength, elongation, impact value, corrosion fatigue strength and pitting corrosion preventive potential. The results of measurements are described in Table 2.

0.2% proof stress indicates a proof stress when 0.2% of permanent elongation occurs in a tensile test.

Impact value was tested by Charpy Impact Testing Equipment with No. 4 test piece as specified in JIS.

Corrosion fatigue strength was measured by Ono's rotary bending fatigue test machine in a corrosive solution (pH 3.5) containing chlorine ions ($CL^-$) by 1000 ppm and sulfate ions ($So_4^{--}$) by 250 ppm. The results mentioned in Table 2 refer to the durability limit ($kg/mm^2$) in $10^8$ cycle of repetition under the test.

Pitting corrosion preventive potential (V, SCE) representing the pitting corrosion resistance refers to the potential at the intersection with the original polarization curve when swept backward after sweeping up to +2 V, SCE at the sweep speed of 240 sec/V in the same corrosive solution as in the test above. The nobler this potential, the higher the pitting corrosion resistance.

Specimens Nos. 1 to 3 are cast steel of the invention, and specimens Nos. 10 to 12 are the cast steel for comparison with those of the invention. No. 11 is the conventionally used material equivalent to JIS SCS 11 and No. 12 is the conventionally used material equivalent to JIS SCS 14.

TABLE 1

| | Chemical Composition of Specimens (wt. %) | | | | | | | | | | |
|---|---|---|---|---|---|---|---|---|---|---|---|
| No | C | Si | Mn | P | S | Ni | Cr | Mo | Cu | Co | V |
| | | | | | Steel of the Invention | | | | | | |
| 1 | 0.06 | 0.63 | 0.69 | 0.015 | 0.014 | 6.80 | 24.19 | 1.52 | 0.75 | 0.88 | 0.68 |
| 2 | 0.04 | 0.80 | 0.88 | 0.017 | 0.013 | 7.20 | 25.52 | 1.80 | 0.55 | 0.75 | 0.70 |
| 3 | 0.07 | 1.12 | 1.00 | 0.020 | 0.015 | 8.18 | 26.50 | 1.70 | 1.52 | 1.08 | 0.56 |
| | | | | | Steel of the Comparison | | | | | | |
| 10 | 0.08 | 0.96 | 0.67 | 0.025 | 0.011 | 5.27 | 23.73 | 0.77 | 0.75 | 0.72 | 0.54 |
| 11 | 0.06 | 1.20 | 0.86 | 0.020 | 0.010 | 8.50 | 25.20 | 1.20 | — | — | — |
| 12 | 0.03 | 0.96 | 0.90 | 0.019 | 0.009 | 10.51 | 20.03 | 2.57 | — | — | — |

TABLE 2

| | Test Results | | | | | |
|---|---|---|---|---|---|---|
| No | 0.2% proof stress ($kg/mm^2$) | Tensile strength ($kg/mm^2$) | Elongation (%) | Impact value ($kg \cdot m/cm^2$) | Corrosion fatigue strength ($kg/mm^2$) | Pitting corrosion preventive potential (V, SCE) |
| | | | Steel of the Invention | | | |
| 1 | 50.3 | 66.2 | 28.0 | 18.0 | 13.5 | 1.24 |
| 2 | 52.6 | 68.1 | 32.0 | 16.6 | 14.0 | 1.26 |
| 3 | 53.2 | 68.0 | 36.4 | 8.8 | 14.2 | 1.20 |
| | | | Steel of the Comparison | | | |
| 10 | 50.3 | 66.2 | 28.0 | 6.6 | 11.0 | 0.07 |
| 11 | 43.7 | 67.1 | 38.6 | 8.0 | 9.4 | 0.05 |
| 12 | 24.3 | 54.1 | 41.3 | 26.4 | 7.0 | 1.25 |

As evident from these results, the cast steels according to the present invention present far better corrosion fatigue strength than the comparison steels in corrosive environments containing chlorine ions, and the pitting corrosion resistance represented by pitting corrosion preventive potential is excellent as compared with comparison steels of specimens Nos. 10 and 11. As for the mechanical properties like proof stress, tensile strength, elongation and impact value, the present steels are equal or superior to the comparison steels in view of strength and toughness. This indicates that the outstanding characteristics of the present steel can be obtained only when the above-mentioned elements are conjointly present in amounts within the specified ranges in the stainless cast steel of ferrite-austenite two phase structure constituting Fe-Cr-Ni as basic components.

Thus, the two phase stainless cast steels of the present invention are excellent in corrosion resistance, strength, toughness and corrosion fatigue strength, and ensure a stability and a durability surpassing those of the conventional materials as the members of the machines and equipment where all aforesaid material characteristics are simultaneously required, such as paper manufacturing rolls, chemical apparatus materials, pump parts and sea water handling equipment materials.

The scope of the invention is not limited to the foregoing description, but various modifications can be made with ease by one skilled in the art without departing from the spirit of the invention. Such modifications are therefore included within the scope of the invention.

What is claimed is:

1. A two-phase ferrite-austenite stainless cast steel having high corrosion fatigue strength consisting essentially of the following components in the following proportions in terms of % by weight:

$0<C\leqq 0.1$,
$0<Si\leqq 2.0$,
$0<Mn\leqq 2.0$,
Cr: 22.0–27.0,
Ni: 5.0–9.0,
Mo: 1.1–2.5,
Cu: 0.5–2.5,
CO: 0.5–2.0 and
V: 0.5–2.0, the balance being substantially Fe and unavoidable impurities.

2. The two-phase stainless cast steel as defined in claim 1 which further contains Nb in the range of 0.05–2.0, or Ta in the range of 0.05–2.0, or Ti in the range of 0.01–0.5, in percent by weight, or a mixture thereof.

3. The two phase stainless cast steel as defined in claims 1 or 2 wherein the C content is equal to or less than 0.05% by weight.

* * * * *